US009899805B2

(12) United States Patent
Kato et al.

(10) Patent No.: US 9,899,805 B2
(45) Date of Patent: Feb. 20, 2018

(54) METHOD FOR MANUFACTURING SPARK PLUG

(71) Applicant: NGK SPARK PLUG CO., LTD., Nagoya-shi, Aichi (JP)

(72) Inventors: Tomoaki Kato, Nagoya (JP); Ryuichi Ohno, Aichi (JP)

(73) Assignee: NGK SPARK PLUG CO., LTD., Nagoya-shi, Aichi (JP)

( * ) Notice: Subject to any disclaimer, the term of this patent is extended or adjusted under 35 U.S.C. 154(b) by 0 days.

(21) Appl. No.: 15/036,607

(22) PCT Filed: Aug. 21, 2014

(86) PCT No.: PCT/JP2014/004302

§ 371 (c)(1),
(2) Date: May 13, 2016

(87) PCT Pub. No.: WO2015/072051

PCT Pub. Date: May 21, 2015

(65) Prior Publication Data

US 2016/0268781 A1 Sep. 15, 2016

(30) Foreign Application Priority Data

Nov. 15, 2013 (JP) ..... 2013-237096

(51) Int. Cl.
*H01T 21/02* (2006.01)
*H01T 13/20* (2006.01)

(52) U.S. Cl.
CPC ..... *H01T 21/02* (2013.01); *H01T 13/20* (2013.01)

(58) Field of Classification Search
CPC ..... H01T 21/02; H01T 13/20
See application file for complete search history.

(56) References Cited

U.S. PATENT DOCUMENTS 5,320,569 A 6/1994 Oshima et al. ..... 445/7
6,997,767 B2 2/2006 Taniguchi et al. ..... 445/7
(Continued)

FOREIGN PATENT DOCUMENTS

CN 101351929 A 1/2009 ..... H01T 13/20
CN 101657944 A 2/2010 ..... H01T 13/20
(Continued)

OTHER PUBLICATIONS

International Search Report issued in corresponding International Patent Application No. PCT/JP2014/004302, dated Nov. 18, 2014.
Office Action received in corresponding Chinese Patent Application No. 201480062358.5, dated Sep. 26, 2016.
(Continued)

*Primary Examiner* — Donald Raleigh
(74) *Attorney, Agent, or Firm* — Kusner & Jaffe

(57) ABSTRACT

Provided is a method for manufacturing a spark plug, wherein at least one of a center electrode and the ground electrode includes an electrode base material and a columnar noble metal tip welded to the electrode base material. The method includes a laser welding step of applying a pulse oscillation laser to form a plurality of unit fusion portions on a peripheral area of a boundary between the electrode base material and the noble metal tip and welding the electrode base material and the noble metal tip. One unit fusion portion is formed by one-time laser irradiation. In the laser welding step, an irradiation axis of the laser is displaced from a central axis of the noble metal tip in a radial direction of the noble metal tip. When a diameter of the noble metal tip is denoted as a diameter A and an amount of displacement of the irradiation axis of the laser is denoted as X, $A/20 \leq |X| \leq A/4$ is satisfied.

10 Claims, 12 Drawing Sheets

(56) References Cited

U.S. PATENT DOCUMENTS

| | | | | |
|---|---|---|---|---|
| 2002/0050775 | A1* | 5/2002 | Hori | H01T 13/39 313/141 |
| 2004/0189169 | A1* | 9/2004 | Taniguchi | H01T 21/02 313/141 |
| 2005/0023949 | A1 | 2/2005 | Hori | 313/141 |
| 2006/0276097 | A1* | 12/2006 | Suzuki | H01T 21/02 445/7 |
| 2007/0103046 | A1 | 5/2007 | Tinwell | 313/143 |
| 2010/0101073 | A1 | 4/2010 | Kato et al. | 29/592.1 |
| 2011/0133625 | A1* | 6/2011 | Sakayanagi | H01T 21/02 313/141 |
| 2011/0148276 | A1 | 6/2011 | Sakayanagi et al. | 313/141 |
| 2011/0193471 | A1* | 8/2011 | Kato | H01T 13/20 313/141 |
| 2013/0038198 | A1 | 2/2013 | Torii et al. | 313/141 |
| 2014/0042892 | A1* | 2/2014 | Kowalski | H01T 13/20 313/141 |

FOREIGN PATENT DOCUMENTS

| | | | | |
|---|---|---|---|---|
| CN | 102160248 | A | 8/2011 | H01T 13/16 |
| JP | H06-188062 | A | 7/1994 | H01T 13/20 |
| JP | 2002-170648 | A | 6/2002 | H01T 13/20 |
| JP | 2005-050732 | A | 2/2005 | B23K 26/32 |
| JP | 2008-270185 | A | 11/2008 | H01T 13/20 |
| WO | WO 2008/123343 | A1 | 10/2008 | B23K 26/20 |

OTHER PUBLICATIONS

Extended European Search Report issued in correspodning EP 14 86 2725 dated Jul. 3, 2017.

* cited by examiner

FIG. 7

| X(mm) | | -0.25 | -0.20 | -0.15 | -0.10 | -0.05 | -0.04 | -0.03 | -0.02 | 0.00 | 0.02 | 0.03 | 0.04 | 0.05 | 0.10 | 0.15 | 0.20 | 0.25 |
|---|---|---|---|---|---|---|---|---|---|---|---|---|---|---|---|---|---|---|
| CONDITION 1 | GENERATION OF WELDING DROOP AND SPATTER (COUNT) | 5 | 2 | 0 | 0 | 0 | 0 | 0 | 2 | 7 | 5 | 0 | 0 | 0 | 0 | 0 | 1 | 2 |
| | GENERATION OF BLOW HOLE (COUNT) | 0 | 0 | 0 | 0 | 0 | 0 | 0 | 2 | 3 | 1 | 0 | 0 | 0 | 0 | 0 | 0 | 0 |
| CONDITION 2 | GENERATION OF WELDING DROOP AND SPATTER (COUNT) | 1 | 0 | 0 | 0 | 0 | 0 | 0 | 3 | 12 | 6 | 4 | 0 | 0 | 0 | 0 | 0 | 4 |
| | GENERATION OF BLOW HOLE (COUNT) | 0 | 0 | 0 | 0 | 0 | 0 | 1 | 1 | 5 | 2 | 1 | 0 | 0 | 0 | 0 | 0 | 0 |

| | D/d(mm) | 1.00 | 1.02 | 1.04 | 1.05 | 1.10 | 1.20 | 1.40 | 1.50 | 1.51 | 1.52 | 1.55 |
|---|---|---|---|---|---|---|---|---|---|---|---|---|
| CONDITION 1 | GENERATION OF WELDING DROOP AND SPATTER (COUNT) | 20 | 7 | 3 | 0 | 0 | 0 | 0 | 0 | 0 | 0 | 0 |
| | GENERATION OF BLOW HOLE (COUNT) | 0 | 0 | 0 | 0 | 0 | 0 | 0 | 0 | 2 | 5 | 14 |
| CONDITION 2 | GENERATION OF WELDING DROOP AND SPATTER (COUNT) | 14 | 6 | 1 | 0 | 0 | 0 | 0 | 0 | 0 | 0 | 0 |
| | GENERATION OF BLOW HOLE (COUNT) | 0 | 0 | 0 | 0 | 0 | 0 | 0 | 0 | 1 | 4 | 9 |

OXIDE SCALE PROGRESS RATE(%)
= (OXIDE SCALE LENGTH B/FUSION PORTION LENGTH C) × 100

B = B1 + B2: OXIDE SCALE LENGTH
C = C1 + C2: FUSION PORTION LENGTH

| FUSION PORTION RATE(%) | 50 | 60 | 70 | 80 | 90 |
|---|---|---|---|---|---|
| OXIDE SCALE PROGRESS RATE(%) | 66 | 59 | 42 | 38 | 32 |
| JUDGMENT | × | × | ○ | ○ | ○ |

FIG. 13

| R (rps) | 1 | 2 | 2 | 5 | 5 | 7 | 7 | 10 | 10 | 15 | 15 | 20 | 20 | 25 | 25 | 25 | 25 | 50 | 50 | 50 | 50 |
|---|---|---|---|---|---|---|---|---|---|---|---|---|---|---|---|---|---|---|---|---|---|
| M (msec) | 10 | 6 | 7 | 6 | 10 | 6 | 10 | 6 | 8 | 4 | 6 | 4 | 6 | 2 | 3 | 3.3 | 3.4 | 1 | 1.5 | 1.6 | 1.7 |
| GENERATION OF WELDING DROOP AND SPATTER (COUNT) | 10 | 7 | 0 | 0 | 0 | 0 | 0 | 0 | 0 | 0 | 5 | 0 | 5 | 0 | 0 | 0 | 0 | 0 | 0 | 0 | 0 |
| GENERATION OF BLOW HOLE (COUNT) | 2 | 3 | 0 | 0 | 0 | 0 | 0 | 0 | 0 | 0 | 4 | 0 | 8 | 0 | 0 | 0 | 1 | 0 | 0 | 0 | 1 |
| 0.36*R*M | 3.6 | 4.3 | 5.0 | 11 | 18 | 15 | 25 | 22 | 29 | 22 | 32 | 29 | 43 | 18 | 27 | 30 | 31 | 18 | 27 | 29 | 31 |
| POWER (W) | 150 | 200 | 180 | 200 | 150 | 200 | 150 | 200 | 170 | 200 | 200 | 200 | 200 | 200 | 300 | 300 | 300 | 500 | 500 | 500 | 500 |
| ENERGY PER LASER SPOT ($J/mm^2$) | 84.9 | 67.9 | 71.3 | 67.9 | 84.9 | 67.9 | 84.9 | 67.9 | 77.0 | 45.3 | 67.9 | 45.3 | 67.9 | 22.6 | 50.9 | 56.0 | 57.7 | 28.3 | 42.4 | 45.3 | 48.1 |

METHOD FOR MANUFACTURING SPARK PLUG

RELATED APPLICATIONS

This application is a National Stage of International Application No. PCT/JP14/04302 filed Aug. 21, 2014, which claims the benefit of Japanese Patent Application No. 2013-237096 filed Nov. 15, 2013.

FIELD OF THE INVENTION

The present invention relates to a method for manufacturing a spark plug.

BACKGROUND OF THE INVENTION

An electrode base material and a noble metal tip are welded by laser welding at a center electrode and a ground electrode of a spark plug in some cases. In laser welding of the electrode base material and the noble metal tip, a so-called "welding droop" where a surface of a fusion portion extends may reach a front end of the noble metal tip, or metal melted by laser irradiation may sputter and adhere to the electrode base material and the noble metal tip. Such welding droop and spatter may lower the ignitability of the spark plug. Further, if a blow hole occurs at the fusion portion during laser irradiation, the joining strength of the fusion portion may be lowered and the noble metal tip may be peeled off from the electrode base material. WO 2008/123343 discloses a technique for suppressing the generation of the spatter, the blow hole, or the like by changing a laser intensity waveform of a rectangular shape used for laser welding.

Recently, a noble metal tip having a higher melting point is used because the temperature of the environment where a spark plug is used is increased and the improvement of the ignitability is desired. When a high energy laser is used to weld an electrode base material and a noble metal tip having a high melting point, a welding droop, a spatter, and a blow hole are more likely to occur. Thus, a technique for further suppressing the welding droop, the spatter, and the blow hole has been desired.

The present invention has been made to solve the above-mentioned problems, and can be achieved as the following embodiments.

SUMMARY OF THE INVENTION (1) According to one embodiment of the present invention, a method for manufacturing a spark plug that includes a center electrode and a ground electrode is provided. At least one of the center electrode and the ground electrode includes an electrode base material and a columnar noble metal tip welded to the electrode base material. The manufacturing method includes a laser welding step of applying a pulse oscillation laser to form a plurality of unit fusion portions on a peripheral area of a boundary between the electrode base material and the noble metal tip and welding the electrode base material and the noble metal tip, the one unit fusion portion being formed by one-time laser irradiation. In the laser welding step, an irradiation axis of the laser is displaced from a central axis of the noble metal tip in a radial direction of the noble metal tip. When a diameter of the noble metal tip is denoted as a diameter A and an amount of displacement of the irradiation axis of the laser is denoted as X, $A/20 \leq |X| \leq A/4$ is satisfied. According to the manufacturing method of this embodiment, by displacing the irradiation axis of the laser from the central axis of the noble metal tip in the radial direction, a unit fusion portion having an elliptical shape and having a major axis along the circumferential direction of the noble metal tip can be formed. Thus, the welding droop toward the front end of the noble metal tip, the spatter, and the blow hole (hereinafter referred to as welding droop or the like) can be suppressed. By setting an amount of displacement X of the irradiation axis of the laser from the central axis of the noble metal tip in the radial direction to be in the range of satisfying $A/20 \leq |X| \leq A/4$, a welding droop or the like can be more effectively suppressed.

(2) According to another embodiment of the present invention, a method for manufacturing a spark plug that includes a center electrode and a ground electrode is provided. At least one of the center electrode and the ground electrode includes an electrode base material and a columnar noble metal tip welded to the electrode base material. The manufacturing method includes a laser welding step of applying a pulse oscillation laser to form a plurality of unit fusion portions on a peripheral area of a boundary between the electrode base material and the noble metal tip and welding the electrode base material and the noble metal tip, the one unit fusion portion being formed by one-time laser irradiation. In the laser welding step, when revolutions per unit time of the electrode base material and the noble metal tip that are rotated relative to the irradiation axis of the laser is denoted R (rps) and a pulse width of the laser is denoted as M (msec), $5 \leq 0.36 \times R \times M \leq 30$ is satisfied. According to this method, a unit fusion portion having an elliptical shape and having a major axis along the circumferential direction of the noble metal tip can be also formed. Thus, a welding droop or the like can be suppressed. By setting the revolutions per second R of the electrode base material and the noble metal tip relative to the irradiation axis of the laser and the laser pulse width to be $M\ 5 \leq 0.36 \times R \times M \leq 30$, a welding droop or the like can be more effectively suppressed.

(3) According to another embodiment of the present invention, a method for manufacturing a spark plug that includes a center electrode and a ground electrode is provided. At least one of the center electrode and the ground electrode includes an electrode base material and a columnar noble metal tip welded to the electrode base material. The manufacturing method includes a laser welding step of applying a pulse oscillation laser to form a plurality of unit fusion portions on a peripheral area of a boundary between the electrode base material and the noble metal tip and welding the electrode base material and the noble metal tip, the one unit fusion portion being formed by one-time laser irradiation. In the laser welding step, the unit fusion portion having an elliptical shape and having a major axis along a circumferential direction of the noble metal tip is formed with use of a laser irradiation device with an optical system in which a laser spot is elliptically-shaped. According to the manufacturing method of this embodiment, since the optical system in which the laser spot is elliptically-shaped is provided, a fusion portion having an elliptical shape and having a major axis along the circumferential direction of the noble metal tip can be formed by laser irradiation of the boundary between the electrode base material and the noble metal tip. Thus, a welding droop or the like can be more easily suppressed.

(4) In the manufacturing methods of the above-described embodiments, the unit fusion portion has an elliptical shape satisfying $1.05 \leq D/d \leq 1.50$ when a maximum width in the circumferential direction of the noble metal tip is denoted as D and a maximum width in a direction parallel to the central axis of the noble metal tip is denoted as d. According to the manufacturing methods of the embodiments, the fusion portion can have a shape that is appropriate to suppress a welding droop or the like.

(5) In the manufacturing methods of the above-described embodiments, $(S2/S1)\times100\geq70$ is satisfied, when an area of a cross-section obtained by cutting off a fusion portion along the circumferential direction of the noble metal tip is denoted as S1 and an area of the fusion portion in the cross-section is denoted as S2, the fusion portion being formed over a whole circumference of the noble metal tip by forming the plurality of unit fusion portions on the peripheral area of the boundary. According to the manufacturing methods of the embodiments, peeling of the noble metal tip from the electrode base material can be prevented.

(6) In the manufacturing methods of the above-described embodiments, in the laser welding step, the peripheral area of the boundary between the electrode base material and the noble metal tip is irradiated with the laser while a laser spot has an energy per unit area of equal to or more than 30 $J/mm^2$. According to the manufacturing methods of the embodiments, even when a welding droop or the like is easily generated because the laser spot having a relatively high energy per unit area such as equal to or more than 30 $J/mm^2$, the unit fusion portions having the elliptical shape and having the major axis along the circumferential direction of the noble metal tip are formed. Thus, the welding droop or the like can be more effectively suppressed.

The present invention can be achieved in various forms other than the above-described method for manufacturing the spark plug. For example, the present invention can be achieved in a form of a spark plug, a center electrode and a ground electrode for a spark plug, a method for manufacturing a center electrode and a ground electrode for a spark plug, or the like.

BRIEF DESCRIPTION OF THE DRAWINGS

FIG. 7 illustrates evaluation results of a welding state when an amount of displacement X of a laser irradiation axis LS is varied on a condition 1 and a condition 2;

FIG. 13 illustrates evaluation results of a welding state when a revolutions per second R and a pulse width M are varied.

DETAILED DESCRIPTION OF THE PREFERRED EMBODIMENTS

A. First Embodiment

A1. Configuration of Spark Plug

Figure 1:
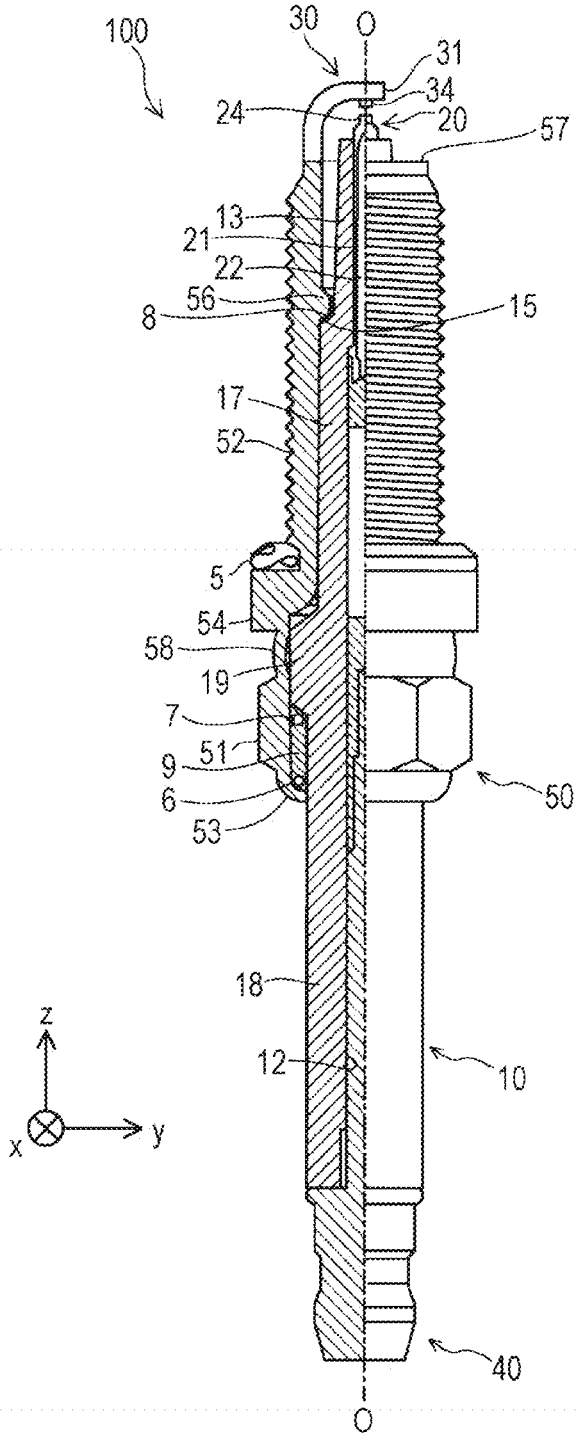
FIG. 1 is a partial sectional view of a spark plug 100.

FIG. 1 is a partial sectional view of a spark plug 100. The spark plug 100 has an elongate shape along with an axial line O as illustrated in FIG. 1. In FIG. 1, the right side of the axial line O shown by the one-dot chain line indicates the exterior front view. The left side of the axial line O indicates the sectional view that cuts off the spark plug 100 by a cross section passing through a central axis of the spark plug 100. In the following description, the upper side parallel to the axial line O in FIG. 1 will be referred to as a front end side, and the lower side in FIG. 1 will be referred to as a rear end side. Xyz axes in FIG. 1 correspond to the xyz axes in other drawings. In FIG. 1, the rear end side of the spark plug 100 is a −z direction, and the front end side of the spark plug 100 is a +z direction. Simply referred to as "the z direction," it means a direction parallel to the z-axis (a direction along with the z-axis). The same applies to the x-axis and the y-axis.

The spark plug 100 includes an insulator 10, a center electrode 20, a ground electrode 30, a terminal metal fitting 40, and a metal shell 50. The rod-shaped center electrode 20 projecting from the front end of the insulator 10 is electrically connected to the terminal metal fitting 40 that is disposed on the rear end of the insulator 10 through the inside of the insulator 10. An outer periphery of the center electrode 20 is held by the insulator 10. An outer periphery of the insulator 10 is held by the metal shell 50 at a position apart from the terminal metal fitting 40. The ground electrode 30, which is electrically connected to the metal shell 50, forms a spark gap that is a clearance to generate spark between itself and the front end of the center electrode 20.

The insulator 10 is an insulator formed by sintering a material such as alumina. The insulator 10 is a cylindrical member that is formed with an axial hole 12 at the center. The axial hole 12 houses the center electrode 20 and the terminal metal fitting 40. A middle body portion 19, which has a large outside diameter, is formed at the middle portion in the axial direction of the insulator 10. A rear end body portion 18, which insulates between the terminal metal fitting 40 and the metal shell 50, is formed at the rear end side of the middle body portion 19. A front end body portion 17, which has a smaller outside diameter than that of the rear end body portion 18, is formed at the front end side of the middle body portion 19. An insulator nose portion 13, which has a smaller outer diameter than that of the front end body portion 17 and the outer diameter of which is reduced toward the front end side, is formed at the front end side of the front end body portion 17.

The metal shell 50 is a cylindrical metal shell that surrounds a portion extending from a part of the rear end body portion 18 of the insulator 10 to the insulator nose portion 13 to hold the portion. In this embodiment, the metal shell 50 is formed of low-carbon steel, and a plating process such as nickel plating and zinc plating is performed on the entire metal shell 50. The metal shell 50 includes a tool engagement portion 51, an installation thread portion 52, and a seal portion 54. The tool engagement portion 51 fits a tool for installation of the spark plug 100 on an engine head. The installation thread portion 52 has a thread to be screwed into an installation thread opening of the engine head. The seal portion 54 is formed in a flange shape at the base of the installation thread portion 52. Between the seal portion 54 and the engine head, an annular gasket 5 formed by folding a plate-shaped body is fitted by insertion.

A thin crimp portion 53 is disposed at the rear end side of the tool engagement portion 51 of the metal shell 50. A compressively deformed portion 58, which is thin similarly to the crimp portion 53, is disposed between the seal portion 54 and the tool engagement portion 51. Annular ring members 6 and 7 are interposed between an inner peripheral surface of the metal shell 50 from the tool engagement portion 51 to the crimp portion 53 and an outer peripheral surface of the rear end body portion 18 of the insulator 10. Further, powder of a talc 9 is filled up between the ring members 6 and 7. When manufacturing the spark plug 100, the crimp portion 53 is folded inward to be pressed toward the front end side, and therefore the compressively deformed portion 58 is compressively deformed. By the compression deformation of the compressively deformed portion 58, the insulator 10 is pressed toward the front end side inside the metal shell 50 via the ring members 6 and 7 and the talc 9. This press compresses the talc 9 in the direction of the axial line O to heighten the air tightness inside the metal shell 50.

At the inner peripheral of the metal shell 50, an insulator step portion 15 is pressed to an in-metal-shell step portion 56 via an annular plate packing 8. The in-metal-shell step portion 56 is disposed at the position of the installation thread portion 52, and the insulator step portion 15 is positioned at a base end of the insulator nose portion 13 of the insulator 10. This plate packing 8 is a member to hold the air tightness between the metal shell 50 and the insulator 10 to prevent the combustion gas from flowing out.

The ground electrode 30 is formed of a metal with high corrosion resistance. As an example, nickel alloy is used. The ground electrode 30 has a base end welded to a front end surface 57 of the metal shell 50. The front end side of the ground electrode 30 is bent in the direction to intersect with the axial line O. At a part of the ground electrode 30 facing to the front end of the center electrode 20, a column-shaped noble metal tip 34 is welded to an electrode base material 31.

The center electrode 20 is a rod-shaped member where a core material 22 is buried inside an electrode base material 21. The core material 22 has higher thermal conductivity than that of the electrode base material 21. The electrode base material 21 is formed of a nickel alloy that includes nickel as a main component, and the core material 22 is formed of copper or an alloy that includes copper as a main constituent. A column-shaped noble metal tip 24 is welded to the electrode base material 21 at the front end of the center electrode 20.

The noble metal tips 24 and 34 are formed of, for example, platinum (Pt), iridium (Jr), ruthenium (Ru), rhodium (Rh), or an alloy containing these metals. Note that the axial line O shown in FIG. 1 is also a central axis O of the noble metal tips 24 and 34.

Figure 2:
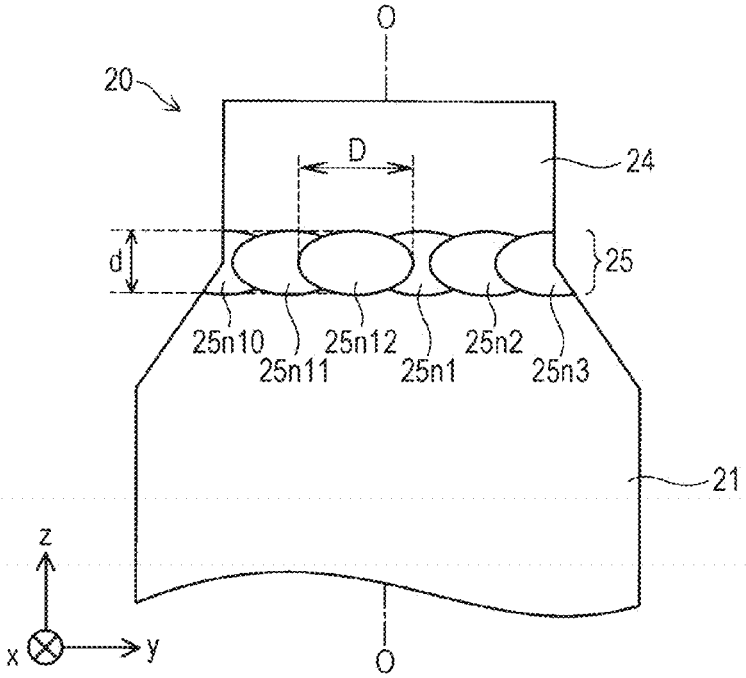
FIG. 2 is an enlarged view of the vicinity of a front end of a center electrode 20.
Figure 3:
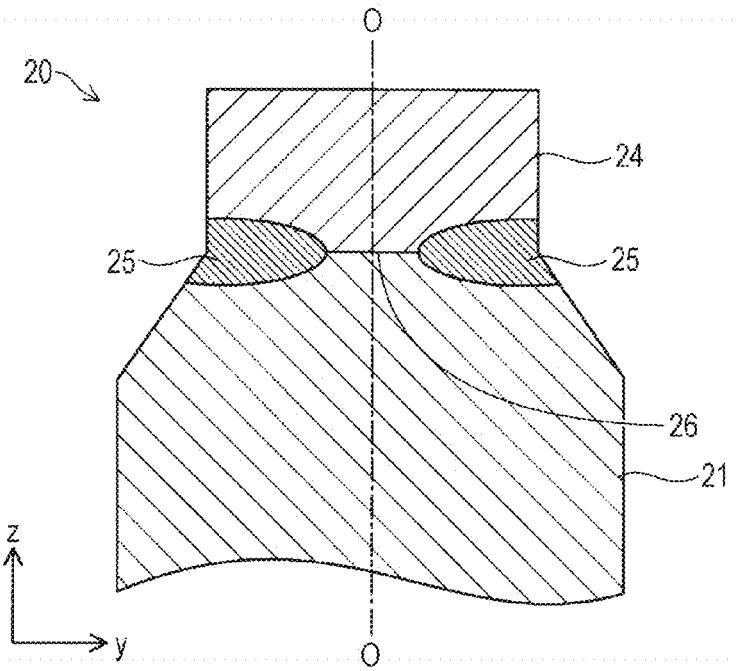
FIG. 3 is an enlarged sectional view of the vicinity of the front end of the center electrode 20.

FIG. 2 is an enlarged view of the vicinity of the front end of the center electrode 20. FIG. 3 is an enlarged sectional view of the vicinity of the front end of the center electrode 20. The center electrode 20 includes a fusion portion 25 formed by melting the electrode base material 21 and the noble metal tip 24 near a boundary 26 (FIG. 3) between the electrode base material 21 and the noble metal tip 24. The fusion portion 25 includes a plurality of unit fusion portions **25*n*1 to 25*n*12 (FIG. 2). The unit fusion portions 25*n*1 to 25*n*12 are formed over a whole circumference in the circumferential direction of the noble metal tip 24. The circumferential direction of the noble metal tip 24 can be also referred to as a circumferential direction of the electrode base material 21 or a circumferential direction near the boundary 26. As illustrated in FIG. 2, the unit fusion portions 25*n*1 to 25*n*12** each overlaps with the adjacent unit fusion portion. Note that a count of the unit fusion portions may be changed as necessary.

The unit fusion portion **25*n*12 is lastly formed among the unit fusion portions 25*n*1 to 25*n*12. The unit fusion portion 25*n*12 has an ellipse shape with a major axis along the circumferential direction of the noble metal tip 24 and a minor axis along the z direction that is parallel to the axial line O. The respective unit fusion portions 25*n*1 to 25*n*12 are formed sequentially under the same condition as described later. Accordingly, it is difficult to confirm the whole shape of the unit fusion portion 25*n*11, for example, which overlaps with the unit fusion portion 25*n*12 formed after the unit fusion portion 25*n*11. However, the unit fusion portion 25*n*11 has an ellipse shape as well as the unit fusion portion 25*n*12**.

In this embodiment, the shape of each of the unit fusion portions **25*n*1 to 25*n*12** is preferred to satisfy the following Formula (1)

$$1.05 \leq D/d \leq 1.50 \qquad \text{Formula (1)}$$

D is the largest width in the circumferential direction of the noble metal tip 24 (major axis), d is the largest width in the direction parallel to the central axis O of the noble metal tip 24 (minor axis). Note that, referring to FIG. 2, the largest width in the circumferential direction of the noble metal tip 24 of the unit fusion portions **25*n*1 to 25*n*12 is the largest length of the unit fusion portions 25*n*1 to 25*n*12 in the y direction when the center electrode 20** is seen in the x direction.

In this embodiment, the fusion portion 25 is preferred to satisfy the following Formula (2).

$$(S2/S1) \times 100 \geq 70 \qquad \text{Formula (2)}$$

S1 is an area of a cross section where a center in the direction parallel to the central axis O (z-axis) of the fusion portion 25 is cut off along the circumferential direction of the noble metal tip 24 (xy plane in FIG. 2). S2 is an area of the fusion portion 25 at the cross section. Note that the direction parallel to the central axis O (z-axis) of the fusion portion 25 may not necessary be a completely parallel direction to the central axis O, and may be a substantially parallel direction, for example, including a deviation of several degrees.

The reason why Formula (1) and Formula (2) are preferred to be satisfied will be described later with experimental results.

A2. Method for Manufacturing Spark Plug

In the manufacturing method in this embodiment, first, the metal shell 50, the insulator 10, the center electrode 20, and the ground electrode 30 are prepared. The center electrode 20 is formed by laser welding of the electrode base material 21 and the noble metal tip 24. The method for laser welding of the electrode base material 21 and the noble metal tip 24 will be described later.

Subsequently, the ground electrode 30 is joined to the metal shell 50. Aside from this, the center electrode 20 is assembled to the insulator 10. Then, an assembly process in which the insulator 10 assembled with the center electrode 20 is assembled to the metal shell 50 is performed. In this assembly process, an assembly body in which the insulator 10 and the center electrode 20 are assembled inside the metal shell 50 is formed.

After the assembly process, a crimping process of the metal shell 50 is performed. In this crimping process, the insulator 10 is secured to the metal shell 50. Then, the noble metal tip 34 is welded to the electrode base material 31 of the ground electrode 30 by laser welding. Lastly, the gasket 5 is mounted between the seal portion 54 of the metal shell 50 and the installation thread portion 52 to complete the spark plug 100. Note that the above-described manufacturing method is merely an example, and the spark plug can be manufactured by various methods different from this method. For example, the order of the above-described process can be changed.

A3. Method for Laser Welding of Electrode Base Material and Noble Metal Tip

Figure 4:
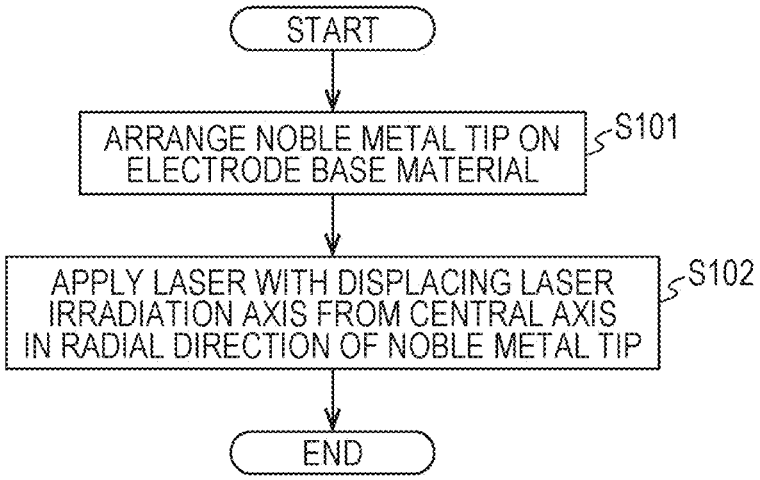
FIG. 4 is a flowchart illustrating a method for laser welding of an electrode base material and a noble metal tip.

FIG. 4 is a flowchart showing the method for laser welding of the electrode base material and the noble metal tip. This method is applied to both of the center electrode 20 and the ground electrode 30. Here, the laser welding for the center electrode 20 will be described as an example. This is similarly applicable to the following embodiment.

First, the noble metal tip 24 is arranged at a predetermined position (in this embodiment, the front end) of the electrode base material 21 (Step S101). In Step S101, resistance welding may be performed to fix the noble metal tip 24 temporarily to the electrode base material 21, or a tool may be used to fix the noble metal tip 24 to the electrode base material 21.

Next, a peripheral area near the boundary 26 between the electrode base material 21 and the noble metal tip 24 is irradiated with laser (Step S102). In Step S102, the electrode base material 21 and the noble metal tip 24 are rotated around the central axis O as the center. With use of a pulse oscillation laser apparatus, unit fusion portions, in which one unit fusion portion is formed at one time laser irradiation, are formed sequentially in the peripheral area near the boundary 26. Thus, the fusion portion 25, which includes the unit fusion portions 25*n*1 to 25*n*12, is formed over the whole circumference of the noble metal tip 24 (the peripheral area near the boundary 26). In this embodiment, the laser is applied from the central axis O of the noble metal tip 24 while a laser irradiation axis LS is displaced in a radial direction of the noble metal tip 24.

In this embodiment, the energy per unit area is equal to or more than 30 J/mm$^2$ at the laser spot. The energy per unit area is calculated by dividing the energy per pulse by the area of the laser spot.

Figure 5A:
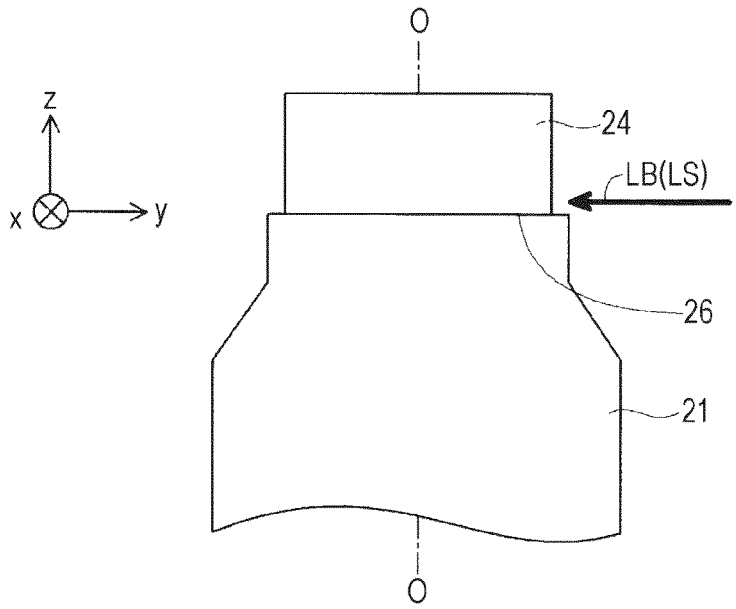
FIGS. 5(*a*) and 5(*b*) illustrate states of a laser welding step according to an embodiment.
Figure 5B:
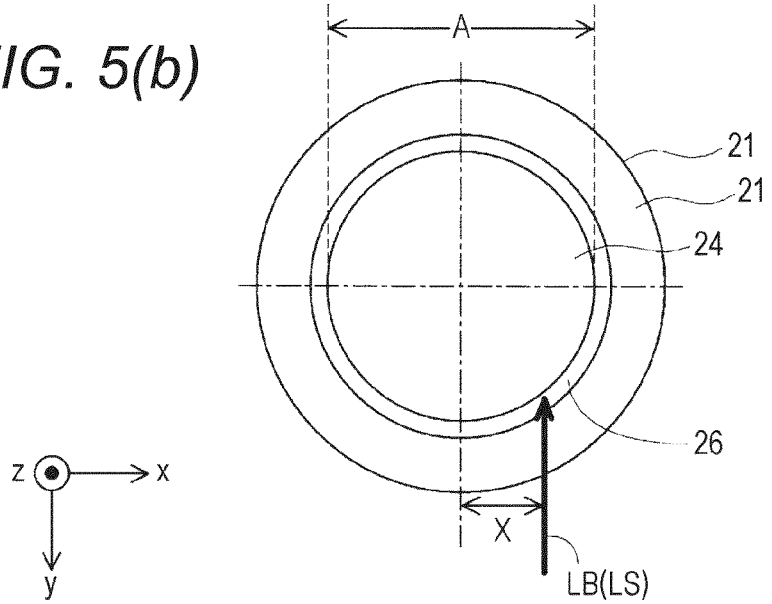

FIGS. 5(*a*) and 5(*b*) illustrate a laser welding step in the embodiment. FIG. 5(*a*) illustrates the laser welding step as viewed in the −x direction, and FIG. 5(*b*) illustrates the laser welding step as viewed in the +z direction. As illustrated in FIG. 5(*a*), a part near the boundary 26 between the electrode base material 21 and the noble metal tip 24 is irradiated with laser beam LB. The laser irradiation axis LS is parallel to the xy plane. As illustrated in FIG. 5(*b*), the laser irradiation axis LS is displaced from the central axis O of the noble metal tip 24 in the radial direction of the noble metal tip 24 (x direction in FIG. 5(*b*)). That is, the laser beam LB is applied to the part near the boundary 26 such that the laser irradiation axis LS does not intersect with the central axis O of the noble metal tip 24. In other words, in the laser welding, the laser irradiation axis LS is displaced from the central axis O of the noble metal tip 24 in the radial direction of the noble metal tip 24 such that the laser irradiation axis LS and the central axis O of the noble metal tip 24 are arranged at a position twisted from each other. Since the irradiation position of the laser beam LB is set in this method and the part near the boundary 26 is irradiated with the laser beam LB, each of the unit fusion portions 25*n*1 to 25*n*12 is formed in an elliptical shape that has a major axis along the circumferential direction of the noble metal tip 24 as illustrated in FIG. 2. In this embodiment, the laser irradiation position is set such that a diameter A of the noble metal tip 24 and an amount of displacement X from the central axis O of the laser irradiation axis LS satisfy the following Formula (3).

$$A/20 \leq |X| \leq A/4 \qquad \text{Formula (3)}$$

In this embodiment, the unit fusion portions 25*n*1 to 25*n*12, each of which has an elliptical shape and has a large diameter along the circumferential direction of the noble metal tip 24, can be formed by displacing the laser irradiation axis LS from the central axis O of the noble metal tip 24 in the radial direction. According to the manufacturing method in this embodiment, the largest width d in the z direction of the fusion portion 25 can be shorter compared with the case where a unit fusion portion in a circular shape that has the same largest width D in the circumferential direction as the unit fusion portion in this embodiment is formed. Thus, the welding droop toward the front end of the noble metal tip 24 and the spatter adhering to the vicinity of the front end of the noble metal tip 24 can be suppressed. Accordingly, even when the thickness of the noble metal tip 24 is relatively thin, the welding droop toward the front end of the noble metal tip 24 and the spatter adhesion can be effectively suppressed and therefore the ignitability of the spark plug can be ensured.

Generally, in a part where unit fusion portions overlap with each other, a blow hole is likely to occur. According to the manufacturing method in this embodiment, however, the fusion portion 25 can be formed by the less count (i.e, number) of shots compared with the case where a unit fusion portion in a circular shape that has the same largest width d in the z direction as the unit fusion portion of this embodiment is formed. Thus, the area of the part of the unit fusion portions overlapping with each other in the fusion portion 25 can be decreased compared with the case where the circular unit fusion portion is formed. Accordingly, the blow hole that is likely to occur at the part where the unit fusion portions overlap with each other can be suppressed.

The laser irradiation position is set such that the amount of displacement of the laser irradiation axis LS satisfies the above-described formula (3). Thus, the welding droop, spatter, and blow hole are more effectively suppressed. Furthermore, as a general tendency, the higher the energy per unit area in the laser spot, the more easily the welding droop, spatter, and blow hole are generated. However, according to the manufacturing method in this embodiment, the energy per unit area in the laser spot is equal to or more than 30 J/mm$^2$, which is equal to or more than approximately 2 to 3 times higher than that in a conventional method. Even when the energy per unit area in the laser spot is relatively high like this, the welding droop, spatter, and blow hole can be suppressed. Accordingly, even when the laser welding is performed to the noble metal tip 24 having a high melting point with a high energy, the welding droop, spatter, and blow hole can be more effectively suppressed.

In the following, the reasons why the electrode base material 21 and the noble metal tip 24 are welded to satisfy Formula (3) will be described based on experimental results.

A4. Example 1 of First Embodiment

In this example, at step S102 of the above-described method for laser welding (FIG. 4, steps S101 and S102), the diameter A of the noble metal tip 24 and the amount of displacement X were made different in the following conditions 1 and 2, and one hundred spark plugs were manufactured for the same diameter A and the same amount of displacement X.

Laser Welding Condition 1
Noble Metal Tip
Diameter A: 0.6 mm
Material: Jr alloy
Laser
Laser power: 200 W
Pulse width: 6 msec
Count of shots: 12 shots
Rotation speed of electrode base material and noble metal tip: 2 rps
Laser spot diameter: 150 μm
Energy per unit area in laser spot: 68 J/mm$^2$, calculated by (200 W×6 msec)/((150 μm/2000)$^2$×π)

Laser Welding Condition 2
Noble Metal Tip
Diameter A: 0.8 mm
Material: Pt alloy
Laser
Laser power: 150 W
Pulse width: 4 msec
Count of shots: 16 shots
Rotation speed of electrode base material and noble metal tip: 2 rps
Laser spot diameter: 150 μm
Energy per unit area in laser spot: 34 J/mm$^2$, calculated by (150 W×4 msec)/((150 μm/2000)$^2$×π)

Next, at the fusion portion of the manufactured spark plug, the generation of the welding droop, spatter, or blow hole was confirmed. Then, the number of the spark plugs, the welding states of which were determined to be defective (NG) because of the generation of the welding droop, spatter, or blow hole, was counted.

Figure 6A:
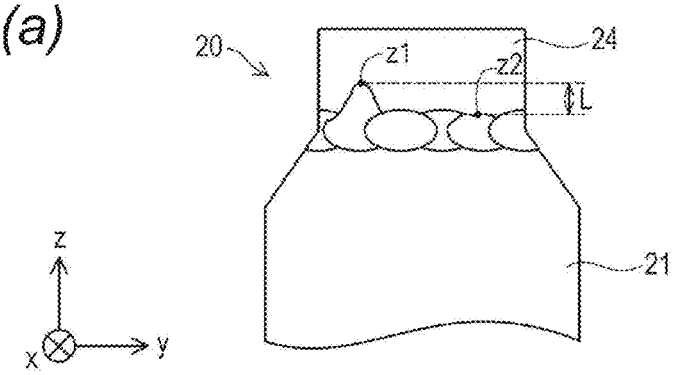
FIGS. 6(*a*), 6(*b*) and 6(*c*) illustrate a fusion portion of the spark plug where a welding droop, a spatter, or a blow hole is generated.
Figure 6B:
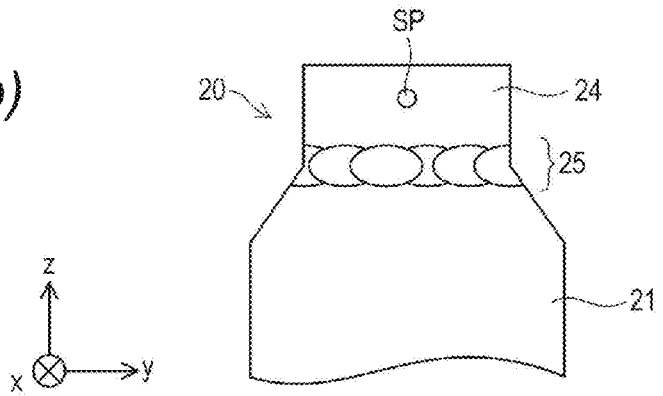
Figure 6C:
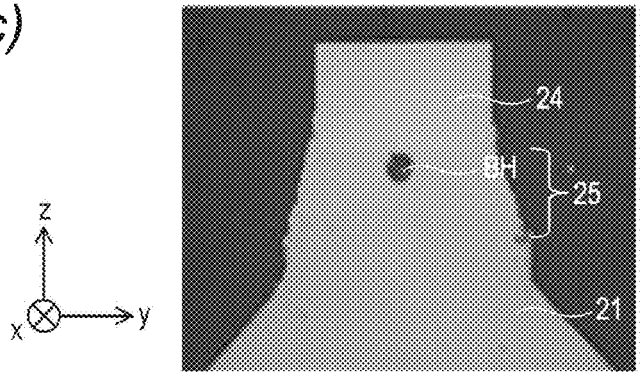

FIGS. 6(*a*), 6(*b*) and 6(*c*) illustrate the fusion portion of the spark plug where the welding droop, spatter, or blow hole was generated. FIG. 6(*a*) illustrates a state where the welding droop was generated at the fusion portion. In this example, a distance L from a front end z1 of the fusion portion that is positioned at the most distal side in the +z direction to a front end z2 of the fusion portion that is positioned at the most distal side in the −z direction was measured. In the case of L≥0.1 mm, the welding state was determined as NG because of the welding droop.

FIG. 6(*b*) illustrates a spark plug where a spatter SP was generated. In this example, when the spatter SP having a diameter equal to or more than 0.1 mm was generated, the welding state was determined as NG because of the spatter.

FIG. 6(*c*) illustrates a spark plug where a blow hole BH was generated. In this embodiment, the center electrode 20 of the spark plug was irradiated with X-rays, and the existence of the blow hole BH was confirmed. The size of the blow hole BH was measured by cutting off a part where the blow hole BH was confirmed and observing the part by a metallurgical microscope. When the size of the measured blow hole BH was equal to or more than 0.1 mm, the welding state was determined as NG because of the blow hole.

FIG. 7 illustrates evaluation results of the welding state where the amount of displacement X of the laser irradiation axis LS was varied on the conditions 1 and 2. FIG. 7 illustrates the amount of displacement X, the count of the spark plugs determined as NG because of the generation of the welding droop and the spatter, and the count of the spark plugs determined as NG because of the generation of the blow hole. In FIG. 7, a range where the count of the spark plugs, the welding state of which was determined as NG because of the welding droop and spatter, or the blow hole, was 0 is indicated with oblique lines.

On the condition 1, when the absolute value of the amount of displacement X was in a range of 0.15≤|X|≤0.03, the welding state of the electrode base material 21 and the noble metal tip 24 was favorable (OK). On the condition 2, when the absolute value of the amount of displacement X was in a range of 0.20≤|X|≤0.04, the welding state was favorable. From a study into a relationship between the amount of displacement X when the welding state was favorable and the diameter A of the noble metal tip 24 on the condition 2, it was found that the welding state was favorable when the absolute value of X was in a range of A/20≤|X|≤A/4.

It was shown from the above-described results that, when the relationship between the absolute value |X| of the amount of displacement X and the diameter A of the noble metal tip 24 satisfies A/20≤|X|≤A/4 (Formula (3)), the fusion portion 25, where the welding droop, spatter, or blow hole was suppressed, was formed and the electrode base material 21 and the noble metal tip 24 were favorably welded.

A5. Example 2 of First Embodiment (Shape Evaluation of Unit Fusion Portion)

Next, the reasons why the welding of the electrode base material 21 and the noble metal tip 24 to satisfy Formula (1) is preferred will be described based on experimental results.

In this example, the largest width of each of the unit fusion portions 25*n*1 to 25*n*12 in the circumferential direction of the noble metal tip 24 is referred to as D, and the largest width in the direction parallel to the central axis O of the noble metal tip 24 (i.e., z direction) is referred to as d. One hundred spark plugs were manufactured every time the value of D/d was varied. The condition 1 and the condition 2 in the above-described example 1 were used as the conditions for laser welding. Next, the count (i.e., number) of the spark plugs, the welding state of which was determined as NG because of the generation of the welding droop, spatter, or blow hole, was counted. The criteria for determining the welding state as NG is similar to those in the above-described example 1, and thus the description thereof will be omitted.

Figure 8:
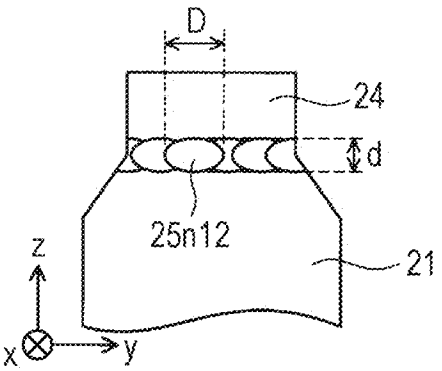
FIG. 8 illustrates evaluation results of a welding state when a value of D/d is varied on the condition 1 and the condition 2 to form unit fusion portions.

FIG. 8 illustrates evaluation results of the welding state where the value of D/d is varied on the condition 1 and the condition 2 to form the unit fusion portions. FIG. 8 illustrates the value of D/d, the count of the spark plugs determined as NG because of the generation of the welding droop and the spatter, and the count of the spark plugs determined as NG because of the generation of the blow hole. In FIG. 8, a range where the count (number) of the spark plugs, the welding state of which was determined as NG because of the welding droop, spatter, or blow hole, was 0 is indicated with oblique lines.

As illustrated in FIG. 8, on the condition 1 and the condition 2, when the value of D/d was in a range of 1.05≤D/d≤1.50 (Formula (1)), the welding droop, spatter, or blow hole was not generated and the welding state was favorable. From the above-described results, it was shown that the welding of the electrode base material 21 and the noble metal tip 24 to satisfy Formula (1) was preferred.

A6. Example 3 of First Embodiment (Anti-Peeling Performance Evaluation of Noble Metal Tip)

Next, the reasons why the welding of the electrode base material 21 and the noble metal tip 24 to satisfy Formula (2) is preferred will be described based on experimental results.

In this example, a plurality of spark plugs, where a fusion portion rate (S2/S1) in a fusion portion formed of unit fusion portions each having an elliptical shape was varied, were manufactured. The fusion portion rate and the anti-peeling performance of the noble metal tip 24 from the electrode base material 21 were evaluated.

Figure 9A:
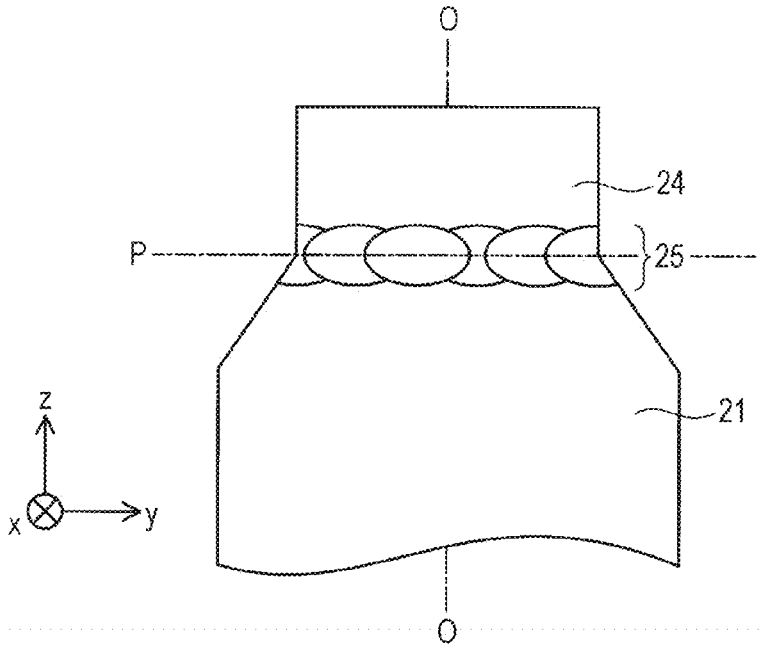
FIGS. 9(*a*) and 9(*b*) illustrate states for calculating a fusion portion rate.
Figure 9B:
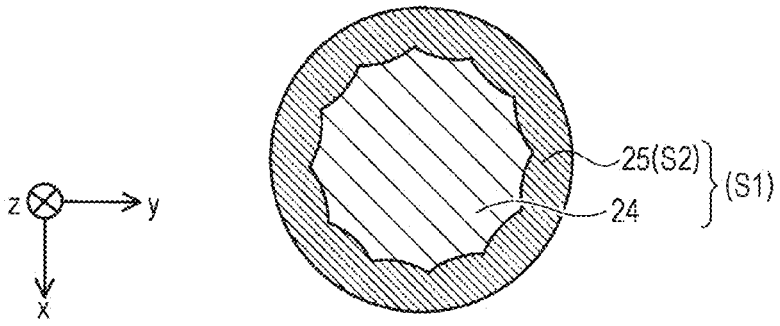

FIG. 9 illustrates a state for calculating the fusion portion rate. FIG. 9(*a*) illustrates a cutting position of the fusion portion 25, and FIG. 9(*b*) illustrates a cross section of the cut fusion portion. The fusion portion rate, as illustrated in FIG. 9(*a*), was obtained by calculating (S2/S1)×100, where S1 is an area of the cross section provided by cutting a center P of the fusion portion 25 in the direction parallel to the central axis O (z-axis) along the circumferential direction of the noble metal tip 24 (xy plane), and S2 is an area of the fusion portion 25 in the cross section. Specifically, by changing the laser welding condition as necessary, spark plugs including unit fusion portions having an ellipse shape and the center electrode 20 with the fusion portion rate of 50%, 60%, 70%, 80%, and 90% were manufactured.

Next, a thermal cyclic test was conducted to evaluate the relationship between the fusion portion rate and the anti-peeling performance of the noble metal tip 24. In the thermal cyclic test, first, the front end of the center electrode 20 was heated by a burner for 2 minutes, so that the temperature of the center electrode 20 was raised to 1000° C. Thereafter, the burner was turned off, and the center electrode 20 was slow-cooled for 1 minute. Then, the center electrode 20 was heated again by the burner for 2 minutes, so that the temperature of the center electrode 20 was raised to 1000° C. This cycle was repeated 1000 times. Next, the fusion portion 25 was cut off at a zy plane passing through the central axis O, and the length of an oxide scale generated near the fusion portion 25 was measured. Then, a progress rate of the oxide scale was obtained by the length of the measured oxide scale.

Figures 10, 11:
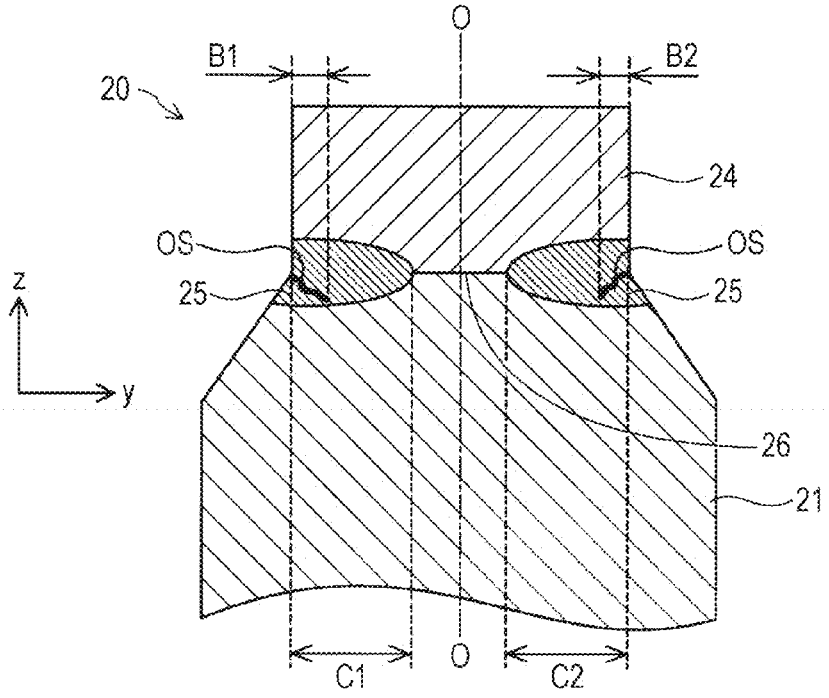
FIG. 10 is a diagram for describing a method for calculating a progress rate of an oxide scale.
FIG. 11 illustrates a relationship between the fusion portion rate and the progress rate of the oxide scale.

FIG. 10 is a diagram for describing a method for calculating the progress rate of the oxide scale. In FIG. 10, the cross-section (half cross-section) of the center electrode 20 of the spark plug for which the thermal cyclic test was conducted was shown. The cross-section was obtained by cutting the center electrode 20 by the zy plane passing through the central axis O. The progress rate of the oxide scale was calculated by respectively obtaining an oxide scale length B to a welding length C and then obtaining a rate of the oxide scale length B to the welding length C. The oxide scale length B is a sum of B1 and B2 that are the length of an oxide scale OS in the y direction in the half cross-section, and the welding length C is a sum of C1 and C2 that are the welding length of the electrode base material 21 and the noble metal tip 24 in the y direction. When the progress rate of the oxide scale OS was less than 50%, the anti-peeling performance was determined to be favorable.

FIG. 11 illustrates the relationship between the fusion portion rate and the progress rate of the oxide scale. As illustrated in FIG. 11, when the fusion portion rate exceeded 70%, the progress rate of the oxide scale became less than 50%. That is, when the fusion portion rate satisfied (S2/S1)×100≥70 (Formula (2)), the anti-peeling performance of the noble metal tip 24 was favorable. From the above-described results, it was shown that the welding of the electrode base material 21 and the noble metal tip 24 to satisfy Formula (2) was preferred.

B. Second Embodiment

B1. Configuration of Spark Plug

The configuration of the spark plug 100 according to this embodiment is similar to the configuration of the spark plug 100 in the first embodiment (FIGS. 1 to 3), and thus the description thereof will be omitted.

B2. Method for Manufacturing Spark Plug

A method for manufacturing the spark plug 100 according to this embodiment is similar to that in the above-described first embodiment, except the method for laser welding of the electrode base material and the noble metal tip. Thus, the description thereof will be omitted.

B3. Method for Laser Welding of Electrode Base Material and Noble Metal Tip

Figure 12:
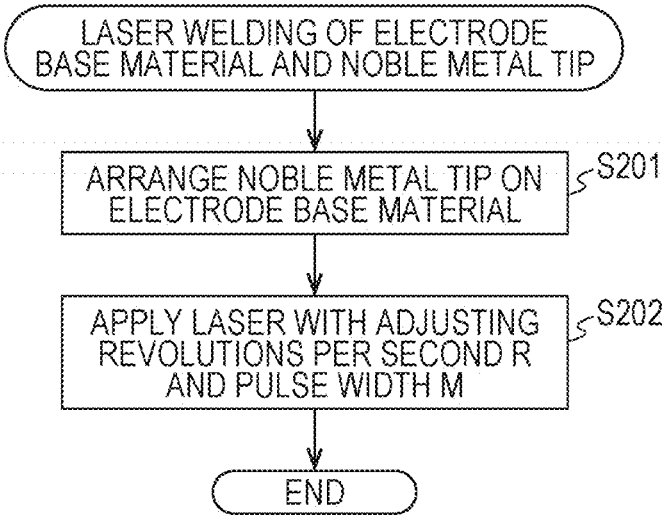
FIG. 12 is a flowchart illustrating a method for laser welding of an electrode base material and a noble metal tip in a second embodiment.

FIG. 12 is a flowchart illustrating a method for laser welding of the electrode base material and the noble metal tip in the second embodiment. In the second embodiment, similarly to the above-described first embodiment, the noble metal tip 24 is arranged at a predetermined position of the electrode base material 21 (Step S201).

Next, the peripheral area near the boundary 26 of the electrode base material 21 and the noble metal tip 24 is irradiated with laser (Step S202). In this embodiment, revolutions per second R (rps) and a laser pulse width M (msec) are adjusted to satisfy the following Formula (4). The revolutions per second R is a count of revolutions per unit of time of the electrode base material 21 and the noble metal tip 24 that relatively rotate with respect to the laser irradiation axis LS. The laser is applied toward the central axis O of the noble metal tip 24 to be parallel to the xy plane.

$$5 \leq 0.36 \times R \times M \leq 30 \qquad \text{Formula (4)}$$

The unit fusion portions 25*n*1 to 25*n*12 each having an elliptical shape that has a major axis along the circumferential direction of the noble metal tip 24 can be formed by adjusting the revolutions per second R and the laser pulse width M to satisfy Formula (4). Thus, the similar advantageous effects to the above-described first embodiment are provided.

According to the manufacturing method in this embodiment, similarly to the first embodiment, even when the energy per unit area in the laser spot is equal to or more than 30 J/mm$^2$, which is higher than that in a conventional method, the welding droop, spatter, or blow hole can be suppressed.

In the following, the reasons why the welding of the electrode base material 21 and the noble metal tip 24 is performed to satisfy Formula (4) will be described based on experimental results.

B4. Example 1 of Second Embodiment

In this example, at the above-described laser irradiation step (Step S202), the revolutions per second R (rps) of the electrode base material 21 and the noble metal tip 24 to rotate around the central axis O and the laser pulse width M (msec) were made different in the following conditions. The one hundred spark plugs were manufactured for each of different conditions. The number of the spark plugs, the welding state of which was determined as NG because of the generation of the welding droop, spatter, or blow hole was counted. The criteria for determining the welding state as NG is similar to the above-described example 1 in the first embodiment, and thus the description thereof will be omitted.

Laser Welding Condition
Noble metal tip
Diameter A: 0.6 mm
Material: Jr alloy
Laser
Pulse width: M (msec)
Rotation speed: R (rps)
Count of shots: 12 shots
Laser spot diameter: Diameter 150 μm FIG. 13 illustrates evaluation results of the welding state when the revolutions per second R (rps) and the pulse width M are varied. FIG. 13 illustrates the revolutions per second R, the pulse width M (msec), a count of spark plugs that were determined as NG because of the generation of the welding droop or the spatter, a count of spark plugs that were determined as NG because of the generation of the blow hole, a value of multiplying the revolutions per second R (rps), the pulse width M (msec), and 0.36 (0.36×R×M), the laser power, and energy per unit area of the laser spot. Incidentally, "0.36×R×M" means "R×360°×(M/1000 (sec))", and corresponds to a turning angle during the laser irradiation. In FIG. 13, a range where the spark plugs that were determined as NG because of the welding droop, spatter, or blow hole do not exist is indicated with oblique lines.

The results in FIG. 13 show that, when the revolutions per second R and the pulse width M satisfied the relationship of $5 \leq 0.36 \times R \times M \leq 30$ (Formula (4)) (when the turning angle was equal to or more than 5° and equal to or less than 30°), the fusion portion 25 where the welding droop, spatter, or blow hole was suppressed was formed and the electrode base material 21 and the noble metal tip 24 were favorably welded.

C. Third Embodiment

C1. Configuration of Spark Plug

The configuration of the spark plug 100 according to this embodiment is similar to the configuration of the spark plug 100 according to the first embodiment (FIGS. 1 to 3). Thus, the description thereof will be omitted.

C2. Method for Manufacturing Spark Plug

A method for manufacturing the spark plug 100 according to this embodiment is similar to that in the above-described first embodiment, except the method for laser welding of the electrode base material and the noble metal tip. Thus, the description thereof will be omitted.

C3. Method for Laser Welding of Electrode Base Material and Noble Metal Tip

Figure 14:
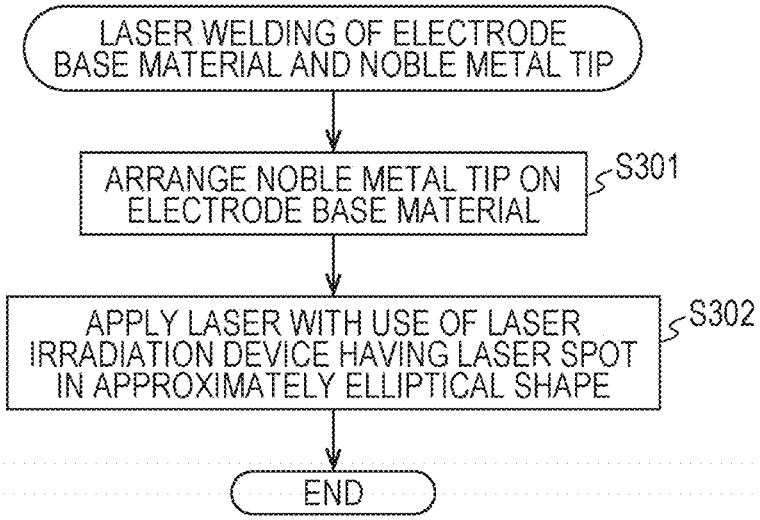
FIG. 14 is a flowchart illustrating a method for laser welding of an electrode base material and a noble metal tip in a third embodiment.

FIG. 14 is a flowchart illustrating a method for laser welding of the electrode base material and the noble metal tip in the third embodiment. In the third embodiment, similarly to the above-described first and second embodiments, the noble metal tip 24 is arranged at a predetermined position of the electrode base material 21 (Step S301).

Next, the peripheral area near the boundary 26 of the electrode base material 21 and the noble metal tip 24 is irradiated with laser (Step S302). In this embodiment, with use of a laser irradiation device having an optical system where a laser spot is elliptically-shaped, the area near the boundary 26 of the electrode base material 21 and the noble metal tip 24 is irradiated with laser. Specifically, a laser irradiation device including a lens that can form an elliptic beam is used to apply the laser. Note that the laser is applied toward the central axis O of the noble metal tip 24 to be parallel to the xy plane. The laser is adjusted such that the major axis of the laser spot is positioned in the circumferential direction of the noble metal tip 24 and the minor axis of the laser spot is positioned in the direction parallel to the central axis O (z-axis) of the noble metal tip 24 to be applied.

As the laser irradiation device having an optical system where a laser spot is elliptically-shaped, various devices, such as a laser irradiation device including a unit to deform a round laser beam into an elliptical laser beam or an irradiation device using a semiconductor laser where a cross-section of an emitted beam is in an elliptical shape, can be used. As a method to deform a round laser beam into an elliptical shape, for example, a laser irradiation device with a lens to form a round laser beam may be used. The laser beam is incident to the lens while an irradiation axis of the laser (incident axis) LS is displaced from the central axis of the lens, and a focus is displaced. With this method, the cross-section of the emitted beam may be formed in the elliptical shape.

The unit fusion portions **25*n*1 to 25*n*12 each having the elliptical shape and having the major axis along the circumferential direction of the noble metal tip 24** can be formed as described above. Then, the similar advantageous effects to the above-described first and second embodiments are provided.

According to the manufacturing method in this embodiment, similarly to the first and second embodiments, the energy per unit area of the laser spot is equal to or more than 30 J/mm$^2$, which is equal to or more than approximately 2 to 3 times higher than that in a conventional method. Even in the case where the energy per unit area of the laser spot is relatively high like this, the welding droop, spatter, or blow hole can be suppressed.

Furthermore, the elliptically-shaped unit fusion portion can be formed without displacing the laser irradiation axis LS with respect to the central axis O of the noble metal tip as in the first embodiment and without adjusting the revolutions per second R of the electrode base material 21 and the noble metal tip 24 and the laser beam pulse width M as in the second embodiment. Thus, the welding droop, spatter, or blow hole can be suppressed by a similar operation to the typical laser welding.

D. Modification

In the above-described various embodiments, the laser welding is performed by irradiating the vicinity of the boundary 26 with laser while rotating the electrode base material 21 and the noble metal tip 24. However, the laser welding may be performed by irradiating the vicinity of the boundary 26 while rotating the laser irradiation device in the circumferential direction of the noble metal tip 24 without rotating the electrode base material 21 and the noble metal tip 24. The laser welding may be performed by irradiating the vicinity of the boundary 26 while rotating the laser irradiation device in the circumferential direction of the noble metal tip 24 and rotating the electrode base material 21 and the noble metal tip 24.

In the above-described various embodiments, the shape of the unit fusion portions **25*n*1 to 25*n*12 is elliptical. However, the shape of the unit fusion portions 25*n*1 to 25*n*12 may not be completely elliptical. For example, it is only necessary that the unit fusion portions 25*n*1 to 25*n*12 have a shape in which a major axis and a minor axis satisfy the above-described Formula (1) and the welding state is not determined as NG because of the welding droop. Insofar as the unit fusion portions 25*n*1 to 25*n*12** have such a shape, the similar advantageous effects to the above-described various embodiments are provided.

In the above-described various embodiments, the methods for laser welding of the electrode base material 21 and the noble metal tip 24 of the center electrode 20 are described.

This method for laser welding may be applied to the electrode base material 31 and the noble metal tip 34 of the ground electrode 30. The noble metal tip 34 may be laser-welded to the electrode base material 31 via an intermediate tip that is interposed between the electrode base material 31 and the noble metal tip 34. When the intermediate tip is used, for example, the noble metal tip 34 is laser-welded to the intermediate tip in advance, and the intermediate tip is resistance-welded or laser-welded to the electrode base material 31 of the ground electrode 30. In this case, the intermediate tip may be regarded as a part of the ground electrode. The intermediate tip may be formed by, for example, the material similar to that of the ground electrode.

The present invention is not limited to the above-described embodiments and modifications. The present invention may be practiced in various forms without departing from its spirit and scope. For example, the technical features described in the embodiments corresponding to the technical features according to the aspects disclosed in DISCLOSURE OF THE INVENTION and the technical feature in the modifications may be replaced or combined as necessary to solve a part of or all of the above-described problems or to obtain a part of or all of the above-described advantageous effects. In addition, the technical features that are not described as requirements in this description may be deleted as necessary.

DESCRIPTION OF REFERENCE SIGNS

5 Gasket
6, 7 Ring member
8 Plate packing
9 Talc
10 Insulator
12 Axial hole
13 Insulator nose portion
15 Insulator step portion
17 Front end body portion
18 Rear end body portion
19 Middle body portion
20 Center electrode
21 Electrode base material
22 Core material
24 Noble metal tip
25 Fusion portion
**25*n*1 to 25*n*12** Unit fusion portion
26 Boundary
30 Ground electrode
31 Electrode base material
34 Noble metal tip
40 Terminal metal fitting
50 Metal shell
51 Tool engagement portion
52 Installation thread portion
53 Crimp portion
54 Seal portion
56 In-metal-shell step portion
57 Front end surface
58 Compressively deformed portion
100 Spark plug
O Central axis (axial line)
P Center of fusion portion
LB Laser beam
LS Laser irradiation axis
BH Blow hole
SP Spatter
OS Oxide scale Having described the invention, the following is claimed:

1. A method for manufacturing a spark plug that includes a center electrode and a ground electrode, at least one of the center electrode and the ground electrode including an electrode base material and a columnar noble metal tip welded to the electrode base material, the method comprising a laser welding step of applying a pulse oscillation laser to form a plurality of unit fusion portions on a peripheral area of a boundary between the electrode base material and the noble metal tip, and welding the electrode base material and the noble metal tip, each of the unit fusion portions being formed by one-time laser irradiation, wherein in the laser welding step, an irradiation axis of the laser is displaced from a central axis of the noble metal tip in a radial direction of the noble metal tip, and $A/20 \leq |X| \leq A/4$ is satisfied when a diameter of the noble metal tip is denoted as a diameter A and an amount of displacement of the irradiation axis of the laser is denoted as X.

2. A method for manufacturing a spark plug that includes a center electrode and a ground electrode, at least one of the center electrode and the ground electrode including an electrode base material and a columnar noble metal tip welded to the electrode base material, the method comprising:

a laser welding step of applying a pulse oscillation laser to form a plurality of unit fusion portions on a peripheral area of a boundary between the electrode base material and the noble metal tip, and welding the electrode base material and the noble metal tip, each of the unit fusion portions being formed by one-time laser irradiation, wherein, in the laser welding step, $5 \leq 0.36 \times R \times M \leq 30$ is satisfied when revolutions per unit time of the electrode base material and the noble metal tip that are rotated relative to the irradiation axis of the laser is denoted as R (rps), and a pulse width of the laser is denoted as M (msec), and wherein each of the unit fusion portions has an elliptical shape satisfying $1.05 \leq D/d \leq 1.50$ when a maximum width in a circumferential direction of the noble metal tip is denoted as D and a maximum width in a direction parallel to the central axis of the noble metal tip is denoted as d.

3. A method for manufacturing a spark plug that includes a center electrode and a ground electrode, at least one of the center electrode and the ground electrode including an electrode base material and a columnar noble metal tip welded to the electrode base material, the method comprising:

a laser welding step of applying a pulse oscillation laser to form a plurality of unit fusion portions on a peripheral area of a boundary between the electrode base material and the noble metal tip, and welding the electrode base material and the noble metal tip, each of the unit fusion portions being formed by one-time laser irradiation, wherein, in the laser welding step, each of the unit fusion portions, which has an elliptical shape and a major axis along a circumferential direction of the noble metal tip, is formed with use of a laser irradiation device with an optical system in which a laser spot is elliptically-shaped, and wherein each of the unit fusion portions has an elliptical shape satisfying $1.05 \leq D/d \leq 1.50$ when a maximum width in the circumferential direction of the noble metal tip is denoted as D and a maximum width in a direction parallel to the central axis of the noble metal tip is denoted as d.

4. The method for manufacturing the spark plug according to claim 1, wherein each of the unit fusion portions has an elliptical shape satisfying $1.05 \leq D/d \leq 1.50$ when a maximum width in a circumferential direction of the noble metal tip is denoted as D and a maximum width in a direction parallel to the central axis of the noble metal tip is denoted as d.

5. The method for manufacturing the spark plug according to claim 1, wherein $(S2/S1) \times 100 \geq 70$ is satisfied, when an area of a cross-section obtained by cutting off a fusion portion along a circumferential direction of the noble metal tip is denoted as Si and an area of the fusion portion in the cross-section is denoted as S2, the fusion portion being formed over a whole circumference of the noble metal tip by forming the plurality of unit fusion portions on the peripheral area of the boundary.

6. The method for manufacturing the spark plug according to claim 1, wherein in the laser welding step, the peripheral area of the boundary between the electrode base material and the noble metal tip is irradiated with the laser while a laser spot has an energy per unit area of equal to or more than 30 $J/mm^2$.

7. The method for manufacturing the spark plug according to claim 2, wherein $(S2/S1) \times 100 \geq 70$ is satisfied, when an area of a cross-section obtained by cutting off a fusion portion along a circumferential direction of the noble metal tip is denoted as S1 and an area of the fusion portion in the cross-section is denoted as S2, the fusion portion being formed over a whole circumference of the noble metal tip by forming the plurality of unit fusion portions on the peripheral area of the boundary.

8. The method for manufacturing the spark plug according to claim 2, wherein in the laser welding step, the peripheral area of the boundary between the electrode base material and the noble metal tip is irradiated with the laser while a laser spot has an energy per unit area of equal to or more than 30 J/mm2.

9. The method for manufacturing the spark plug according to claim 3, wherein $(S2/S1) \times 100 \geq 70$ is satisfied, when an area of a cross-section obtained by cutting off a fusion portion along the circumferential direction of the noble metal tip is denoted as Si and an area of the fusion portion in the cross-section is denoted as S2, the fusion portion being formed over a whole circumference of the noble metal tip by forming the plurality of unit fusion portions on the peripheral area of the boundary.

10. The method for manufacturing the spark plug according to claim 3, wherein in the laser welding step, the peripheral area of the boundary between the electrode base material and the noble metal tip is irradiated with the laser while a laser spot has an energy per unit area of equal to or more than 30 J/mm2.

* * * * *